US005280416A

United States Patent [19]

Hartley et al.

[11] Patent Number: 5,280,416

[45] Date of Patent: Jan. 18, 1994

[54] BOOKMARK LIGHT

[75] Inventors: John B. Hartley; Belton A. Copp, both of Providence, R.I.

[73] Assignee: Eye Design, Inc., Providence, R.I.

[21] Appl. No.: 982,469

[22] Filed: Nov. 27, 1992

[51] Int. Cl.[5] ..... A47B 19/00

[52] U.S. Cl. ..... 362/98; 362/191; 362/198; 362/287

[58] Field of Search ..... 362/98, 99, 155, 191, 362/427, 251, 287, 288, 190

[56] References Cited

U.S. PATENT DOCUMENTS

| | | | |
|---|---|---|---|
| 1,243,600 | 10/1917 | Hambright | 362/99 |
| 1,768,733 | 7/1930 | Becket | 362/98 |
| 2,480,800 | 8/1949 | Wickwire | 362/191 |
| 2,561,744 | 7/1951 | Langdon et al. | 362/98 |
| 3,823,312 | 7/1974 | Weinstein | 362/98 |
| 4,432,042 | 2/1984 | Zeller | 362/99 |
| 4,442,478 | 4/1984 | Stansbury | 362/155 |
| 4,598,340 | 7/1986 | Dwosh et al. | 362/199 |
| 4,680,681 | 7/1987 | Fisherman et al. | 362/98 |
| 5,065,297 | 11/1991 | Santambrogio | 362/427 |
| 5,169,226 | 12/1992 | Friedman | 362/427 |

FOREIGN PATENT DOCUMENTS

| | | | |
|---|---|---|---|
| 162447 | 5/1921 | United Kingdom | 362/99 |

*Primary Examiner*—Ira S. Lazarus
*Assistant Examiner*—Y. Quach
*Attorney, Agent, or Firm*—Salter, Michaelson & Benson

[57] ABSTRACT

A lighting device is operative for use as a bookmark and as a reading light. The body of the lighting device is constructed in a substantially flat configuration wherein it can easily be placed between the pages of a book to mark a position therein. The device further includes a slide arm having a light source mounted at the end thereof. The slide arm is slidably movable outwardly of the body wherein the lamps are automatically turned on and positioned over the body. For use as a reading light, the body of the device is placed between pages of the book, or between one of the covers and the adjacent pages of the book, wherein the lights thereof are positioned substantially over the open pages of the book that are being read.

9 Claims, 2 Drawing Sheets

BOOKMARK LIGHT

BACKGROUND OF THE INVENTION

The instant invention is related to lighting devices and more particularly to a lighting device which is functional for use as a reading light and as a bookmark for marking a position in a closed book.

Reading lights which are operable for directing a source of light directly onto the open pages of a book are well known in the art. In this regard, reading lights typically comprise a desk lamp type light having an adjustable neck which allows the light to be positioned over the pages of the book.

Book marking devices for marking a page within a book are also well known in the art. In this regard, traditional bookmarks typically comprise an elongated, generally flat member which is positionable between the pages of a book in order to mark a position therein when the book is closed.

SUMMARY OF THE INVENTION

The instant invention provides a lighting device which is functional for use as a reading light and as a bookmark.

Briefly, the lighting device comprises an elongated body, an elongated slide arm slidably mounted in the body, a lamp assembly mounted at one end of the slide arm, a battery for supplying electrical power to the lamp assembly, and an electrical circuit for electrically interconnecting the lamp assembly with the battery. The body is generally flat in configuration and it includes an enlarged cylindrical compartment at one end thereof and spaced, oppositely disposed trackways which extend along the length of the body. The battery is inserted through an opening in one end of the cylindrical compartment, and a circular cover plate is received over the opening to maintain the battery therein. The electrical circuit comprises positive and negative terminal assemblies which communicate with the battery and include slide contacts which are mounted in the trackways. A switch is provided for opening and closing the circuit. The slide arm comprises a substantially flat strip of flexible plastic, which is preferably cast in a curved shape. Elongated metal strips are mounted along the edges of the slide arm and the lamp assembly is mounted at one end of the slide arm. The lamp assembly comprises a pair of incandescent lamps which are mounted within a plastic housing. The lamps are received and secured in the housing and the housing is received and secured onto the slide arm. The electrical terminals of the lamps are electrically connected with the metal strips of the slide arm, and the slide arm is received in the trackways in the body, wherein the metal strips make sliding electrical contact with the positive and negative slide contacts in order to complete the electrical circuit. The slide arm is slidable within the trackways between a first position, wherein the arm is slidably withdrawn into the body, and a second position wherein the slide arm is slidably extended outwardly of the body. When the slide arm is completely withdrawn into the body it engages the switch to break the circuit and de-energize the lamps. On the other hand, when the slide arm is slidably extended outwardly of the body, the switch moves back to its original position to close the circuit and energize the lamps. When the slide arm is extended outwardly of the body, it reversely bends into its original curved form so that the lamps are positioned over the body.

For use of the device as a bookmark, the slide arm is withdrawn into the body and the device is positioned between pages of a closed book in a similar manner to a conventional bookmark. Since the body is generally flat in configuration, it will not harm the binding of the book when the book is maintained in a closed state. For use of the device as a reading light, the device is removed from between the pages of the book and the slide arm is extended outwardly of the body wherein the lamps are energized and positioned over the body of the device. The body of the device may then be placed under the book, or between pages of the book so that the lamps thereof are positioned substantially over the open pages of the book.

Accordingly, it is an object of the instant invention to provide a reading light.

It is another object of the invention to provide a bookmark.

It is still another object to provide a lighting device which is functional for use both as a bookmark and as a light for reading.

It is yet another object to provide a lighting device having a generally flat body portion and an elongated slide arm slidably mounted within the body.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENT

Figure 1:
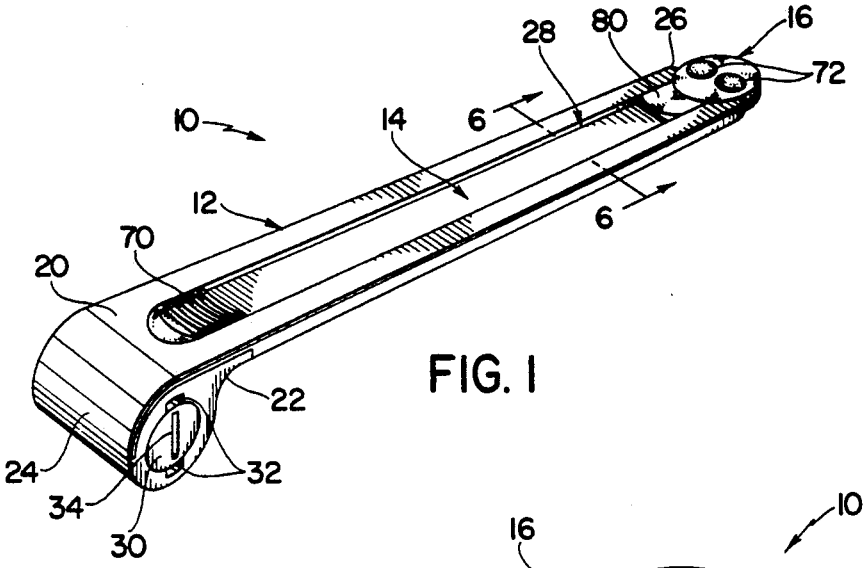
FIG. 1 is a perspective view of the bookmark light of the instant invention with the slide arm withdrawn into the body.
Figure 2:
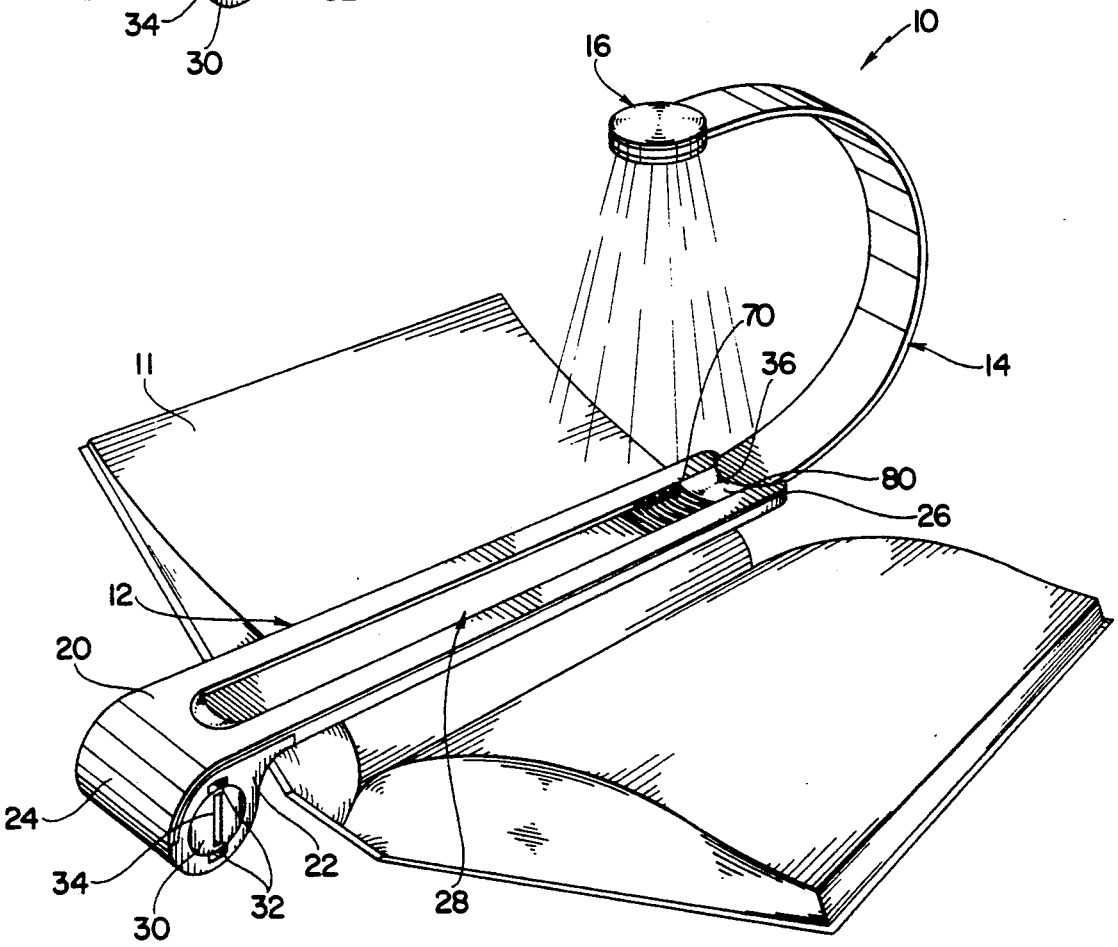
FIG. 2 is another perspective view thereof with the slide arm slidably extended outwardly of the body into its operative lighting position.

Referring now to the drawing FIGURES, the bookmark light of the instant invention is illustrated and generally indicated at 10 in FIGS. 1 and 2. As will hereinafter be more fully set forth, the device 10 is operative for use as a reading light and also as a bookmark for marking a position within a book 11. The device 10 comprises an elongated body generally indicated at 12, an elongated slide arm generally indicated at 14, a lamp assembly generally indicated at 16 mounted at one end of the slide arm 14, a battery 18 for supplying electrical power to 12 the lamp assembly 16, and an electrical circuit for electrically interconnecting the lamp assembly 16 with the battery 18.

The body 12 comprises upper and lower body section halves 20 and 22 respectively, which are received and secured in interfitting engagement so that they cooperate to define the body 12. The upper and lower body sections 20 and 22, are generally flat in configuration and they are preferably molded or formed from a reinforced polycarbonate plastic, such as ABS (Dupont TM). The body section halves 20 and 22 cooperate to define an enlarged cylindrical compartment 24 at one end of the body 12, a head portion 26 at the other end thereof and a slotted trackway generally indicated at 28 which extends lengthwise of the body 12 between the cylindrical compartment 24 and the head portion 26. The cylindrical compartment 24 houses the battery 18 which is slidingly received within the cylindrical compartment 24 through a circular opening 29 on one side thereof. A circular cover plate 30 is received over the opening to maintain the battery 18 therein. The cover plate 30 and lower body section half 22 are provided with an interlocking tongue and groove arrangement 32 which releasably maintains the cover 30 in locked position over the opening 29. The cover 30 further includes a slot 34 on the outer surface thereof to facilitate removal of the cover 30 with a flat object, such as a coin or other like implement.

The head portion 26 of the body 12 includes an arcuate edge 36 (FIG. 2) which is adapted to snugly receive the circular lamp assembly 16 when the slide arm 14 is slidably withdrawn into the body 12. The slotted trackway 28 comprises a recessed channel 38 which longitudinally extends along the central portion of the lower body section half 22 in registry with an elongated opening 40 located in the center portion of the upper body section half 20. Still further, the upper and lower body section halves 20 and 22 cooperate to define spaced, oppositely disposed longitudinal channels 42 and 44, which extend for the length of the slotted trackway 28. The upper and lower body section halves 20 and 22 are provided with a plurality of interengaging tabs 46 and slots 48 (See FIGS. 3 and 6) which function to secure the body sections 20 and 22 together in interfitting relation.

Figure 3:
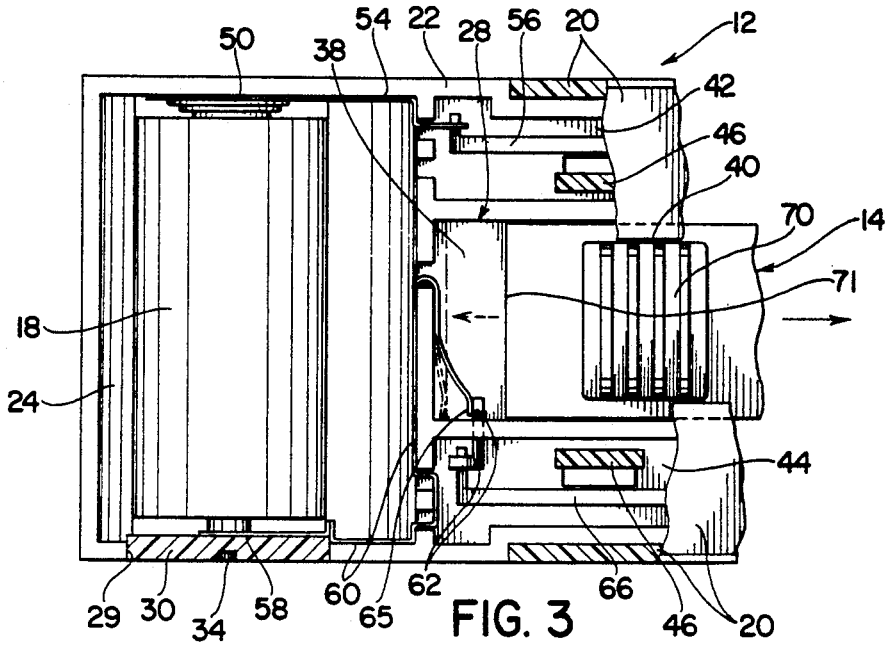
FIG. 3 is a fragmentary plan view with portions broken away to reveal the detailed structure of the electrical switch.
Figure 4:
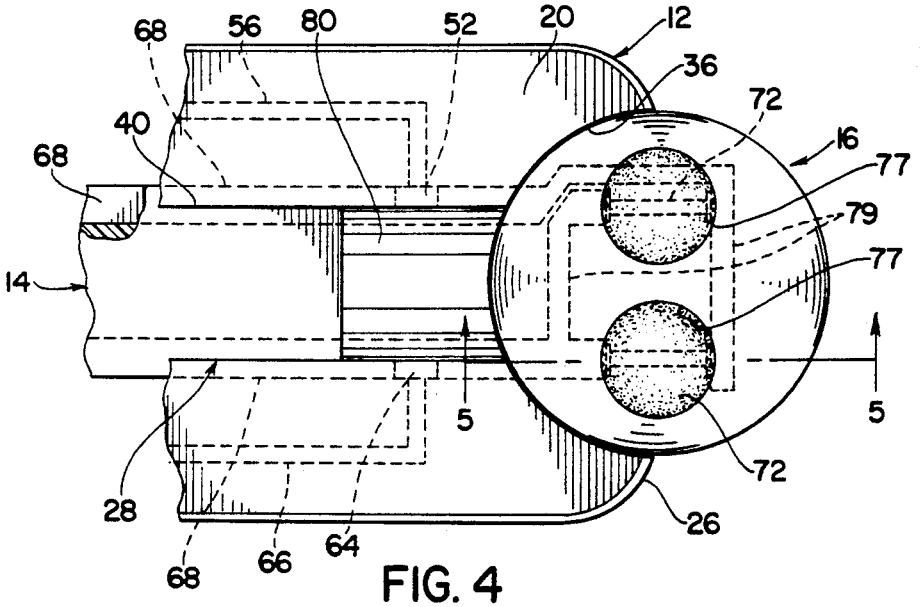
FIG. 4 is another fragmentary plan view of the bookmark light with the structure and arrangement of the sliding electrical contacts shown in detail.

Referring now to FIGS. 3 and 4, the electrical circuit comprises a negative terminal assembly and a positive terminal assembly. The negative terminal assembly comprises a coil spring terminal 50 mounted at the closed end of the battery compartment 24 (FIG. 3), and a slide contact 52 mounted on the bottom of the track 28 (shown in broken lines in FIG. 4). The spring terminal 50 electrically communicates with the negative terminal of the battery 18 and it includes a terminal lead 54 which extends out of the battery compartment 24 into the adjacent longitudinal channel 42 where it electrically communicates with the slide contact 52 by means of an electrically conductive wire or strip 56 (solid lines in FIG. 3 and broken lines in FIG. 4) which extends along the length of channel 42. The positive terminal assembly comprises a blade terminal 58 mounted to the inner side of the battery compartment cover 30, a switch lead 60, a switch contact 62, and a slide contact 64. When the cover 30 is locked in position, the blade terminal 58 electrically communicates with the positive terminal of the battery 18 and further electrically communicates with the switch lead 60 which extends out of the battery compartment 24 and into the slotted trackway 28. A terminal end 65 of the switch lead 60 electrically communicates with the switch contact 62 which is mounted in the slotted trackway 28. The switch contact 62 extends into the adjacent longitudinal channel 44 and electrically communicates with the slide contact 64 by means of an electrically conductive wire or strip 66 (solid lines in FIG. 3 and broken lines in FIG. 4) which extends along the length of channel 44. The terminal end 65 of the switch lead 60 is movable between a first position (solid lines) wherein it electrically communicates with the switch contact 62 and a second position (broken lines) wherein it is disengaged from the switch contact 62. In this regard, the switch lead 60 is normally biased to the said first position where it electrically communicates with the switch contact 62.

Figure 6:
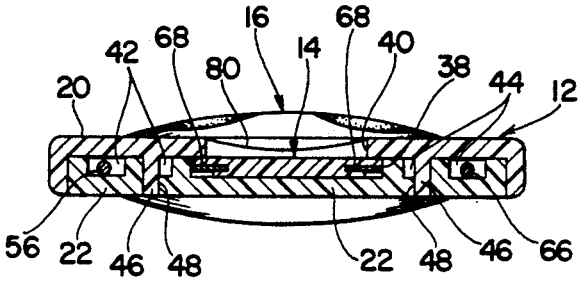
FIG. 6 is a cross sectional view taken along line 6—6 in FIG. 1.

The slide arm 14 comprises a substantially flat strip of flexible plastic, such as LEXAN (DuPont TM), which is preferably cast in a curved shape (See FIG. 2). Referring to FIG. 6, the slide arm has a generally T-shape cross section with slots formed along the opposite edges thereof. Elongated metal strips 68 ar mounted within the slots to provide sliding electrical communication with the positive and negative slide contacts 52 and 64 mounted on the bottom of the slotted trackway 28. One end of the slide arm 14 is provided with integrally molded ridges 70 which protrude outwardly from an upper surface thereof and the lamp assembly 16 is mounted at the opposite end thereof. The ridges 70 function as friction means that may be engaged by the user's finger to facilitate sliding movement of arm 14.

Figure 5:
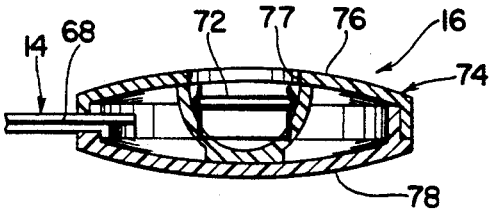
FIG. 5 is a cross sectional view taken along line 5—5 in FIG. 4.

The lamp assembly 16 comprises a pair of conventional lamps 72 which are mounted within a plastic housing generally indicated at 74 in FIG. 5. The lamp housing 74 comprises first and second housing section halves 76 and 78 respectively, which are received and secured in interfitting engagement so that they cooperate to define the lamp housing 74. The lamps 72 are received and secured between the housing section halves 76 and 78, and the housing 74 is received and secured onto the slide arm 14 so that the lamps 72 face upwardly, i.e., in the same direction as the protruding ridges 70. Openings 77 are provided in section half 76 in registry with lamps 72 in order that illumination from the lamps 72 may pass outwardly through housing 74. The electrical terminals of the lamps 72 are electrically connected in series by conductive strips 79, which also electrically communicate with the metal strips 68 of the slide arm 14, as illustrated in broken lines in FIG. 4.

The slide arm 14 is slidably received in the slotted trackway 28 in the body 12, wherein the metal strips 68 make sliding electrical contact with the positive and negative slide contacts 52 and 64 in order to complete the electrical circuit. The slide arm 14 is slidable within trackway 28 between a first position, wherein the slide arm 14 is slidably withdrawn into the body 12 (FIG. 1), and a second position wherein the slide arm 14 is slidably extended outwardly of the body 12 (FIG. 2). When the slide arm 14 is completely withdrawn into the body 12, its inner end 71 passes over contact 62 and engages the terminal end 65 of the switch lead 60 to depress same and move it out of electrical contact with the switch contact 62 to break the circuit and de-energize the lamps 72. On the other hand, when the slide arm 14 is slidably extended outwardly of the body 12, the terminal end 65 of switch lead 60 automatically by its spring bias moves back into contact with the switch contact 62 to close the circuit and energize the lamps 72. It can thus be appreciated that when the slide arm 14 is withdrawn, the lamps 72 are shut off, and when the slide arm 14 is extended, the lamps 72 are turned on. It can also be appreciated that when the slide arm 14 is completely withdrawn inside the body 12, the circular housing 74 of the lamp assembly 16 is received in snug fitting engagement with the arcuate edge 36 at the head 26 of the body 12. Still further, it can be seen that when the slide arm 14 is extended outwardly of the body 12, it automatically reversely bends into its original curved form (FIG. 2) so that illumination from the lamps 72 is directed downwardly towards the body 12. It is pointed out that a bridge portion 80 adjacent the arcuate edge 36 on the upper body section half 20 prevents the slide arm 14 from becoming disengaged from the body 12 because the raised ridges 70 engage bridge 80 to prevent further sliding movement of arm 14.

For use of the device 10 as a bookmark, the slide arm 14 is completely withdrawn into the body 12 and the device 10 is positioned between the pages of a book 11 in a similar manner as a conventional bookmark. Since the body 12 is generally flat in configuration, it will not damage the binding of the book 11 when the book 11 is maintained in a closed state, it being understood that in this mode, the cylindrical compartment 24 will be positioned outside of the book, as illustrated in FIG. 2. For use of the lighting device 10 as a reading light, the device 10 is removed from between the pages of the book 11 and the slide arm 14 is extended outwardly of the body 12, wherein the lamps 72 automatically become lighted and are positioned so that the light is directed towards the body 12 of the device 10. The body 12 of the device 10 may then be positioned under the book 11, or between the pages of the book 11 adjacent one of the covers thereof, so that the lamps 72 are positioned substantially over the open pages of the book 11 that are being read. The lamps 72 have a sufficient brightness to illuminate the pages of the book 11 for reading thereof.

It is seen therefore, that the instant invention provides an effective lighting device and bookmark. The body 12 of the device 10 is constructed in a substantially flat configuration, and in this regard, it is functional for placement between the pages of a book 11 in order to mark a position within the book 11. The slide arm 14 of the device 10 is operative for slidable movement outwardly of the body 12 wherein the lamps 72 thereof are automatically turned on and are positioned so as to direct their light towards the body 12. When placed under a book or between the pages adjacent one of the covers thereof, the lamps 72 are positioned substantially over the open pages of the book 11 wherein the lamps 72 throw sufficient light upon the pages for reading thereof. For these reasons, it is believed that the lighting device of the instant invention represents a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A combination bookmark and lighting device comprising:

a substantially flat, elongated body portion;

a substantially flat, elongated arm portion mounted on said body portion and movable between a first position wherein said body portion and said arm portion define a substantially flat assembly, and a second position wherein one end of said arm portion is located substantially over said body portion, said flat assembly having a thickness which is suitable for placement between pages of a book for marking a position therein;

light means mounted at said one end of said arm portion so as to illuminate the pages of said book when said arm portion is in said second position; and power means for energizing said light means.

2. In the combination bookmark and lighting device of claim 1, means responsive to movement of said arm portion from said first position to said second position for automatically energizing said light means and for automatically de-energizing said light means when said arm portion is moved from said second position to said first position.

3. In the combination bookmark and lighting device of claim 1, said arm portion being slidably mounted in said body portion.

4. In the combination bookmark and lighting device of claim 3, said arm portion comprising an elongated resilient strip which is normally biased to a reversely bent configuration, said resilient strip being retained n a flattened configuration when in said first position, and automatically assuming said reversely bent configuration when slidably moved to said second position.

5. The combination bookmark and lighting device of claim 4, further comprising means responsive to movement of said arm portion from said first position to said second position for automatically energizing said light means and for automatically de-energizing said light means when said arm portion is moved from said second position to said first position.

6. A lighting device comprising:

a substantially flat, elongated body portion including a slotted trackway;

a substantially flat, elongated arm portion slidably mounted in said body portion and slidably movable between a first position wherein said arm portion is slidably withdrawn into said body portion and a second position wherein one end of said arm portion is substantially positioned over said body portion, said body portion and said arm portion defiling a substantially flat assembly when said arm portion is in said first position, said arm portion comprising a resilient strip of plastic which is normally biased to a reversely bent configuration, said resilient strip being slidably mounted in said slotted trackway, said resilient strip being retained in a flattened configuration in said slotted trackway when in said first position and automatically assuming said reversely bent configuration when slidably extended outwardly of said slotted trackway to said second position;

light means mounted at said one end of said arm portion;

power means for energizing said light means;

circuit means electrically interconnecting said power means and said light means; and switch means responsive to movement of said arm portion from said first position to said second position for automatically energizing said light means and for automatically de-energizing said light means when said arm portion is moved from said second position to said first position.

7. In the lighting device of claim 6, said body portion further comprising an enlarged compartment at one end thereof, said compartment receiving said power means therein.

8. In the lighting device of claim 6, said circuit means comprising a pair of metal contacts mounted on opposite sides of said slotted trackway and metal strips mounted on said arm portion, said metal strips making sliding electrical contact with said metal contacts when said arm portion is slidably mounted in said slotted trackway.

9. A lighting device comprising:

a generally flat, elongated body portion including a slotted trackway;

a generally flat, elongated arm portion slidably mounted in said body portion and slidably movable between a first position wherein said arm portion is slidably withdrawn into said body portion and a second position wherein one end of said arm portion is substantially positioned over said body portion, said arm portion comprising a resilient strip of plastic which is normally biased to a curved configuration, said resilient strip being slidably mounted in said slotted trackway, said resilient strip being retained in a flattened configuration in said slotted trackway when in said first position and automatically assuming said curved configuration when slidably extended outwardly of said slotted trackway to said second position;

light means mounted at said one end of said arm portion;

power means for energizing said light means;

circuit means electrically interconnecting said power means and said light means, said circuit means comprising a pair of metal contacts mounted on opposite sides of said trackway and metal strips mounted on said arm portion, said metal strips making sliding electrical contact with said metal contacts when said arm portion is slidably mounted in said slotted trackway; and switch means responsive to movement of said arm portion between said first position and said second position, said switch means comprising a stationary contact and a spring loaded contact mounted in said trackway, said spring loaded contact being normally biased to contact said stationary contact so that when said arm portions moved from said second position to said first position, said arm portion slides over said stationary contact and engages said spring loaded contact to move said spring loaded contact out of engagement with said stationary contact and de-energize said light means, and when said arm portion is moved from said first position to said second position, said spring loaded contact automatically moves back into contact with said stationary contact to energize said light means.

* * * * *